United States Patent [19]

Schrader

[11] 3,992,124

[45] Nov. 16, 1976

[54] DEVICE FOR THE ADJUSTMENT OF THE WORKING WIDTH OF ROAD FINISHERS

[76] Inventor: Ernst-August Schrader, Hohenfeldstr. 22, Lingen-Laxten, Germany, 445

[22] Filed: Sept. 30, 1975

[21] Appl. No.: 618,117

[30] Foreign Application Priority Data

Oct. 12, 1974 Germany ..... 2448665
May 16, 1975 Germany ..... 2522457

[52] U.S. Cl. ..... 404/118
[51] Int. Cl.[2] ..... E01C 19/12
[58] Field of Search ..... 404/101, 102, 118, 119

[56] References Cited

UNITED STATES PATENTS

| | | | |
|---|---|---|---|
| 3,557,672 | 1/1971 | Shurtz | 404/118 |
| 3,572,227 | 3/1971 | Poulsen | 404/118 |
| 3,907,451 | 9/1975 | Fisher et al. | 404/118 |
| 3,907,451 | 9/1975 | Fisher et al. | 404/101 |

*Primary Examiner*—Henry S. Jaudon
*Attorney, Agent, or Firm*—McGlew and Tuttle

[57] ABSTRACT

A device for adjusting the working width of a road finisher, comprises a main support beam which is adapted to be carried by the road finisher behind the device for finishing the road surface. The main support beam includes a central plate portion having a pair of tubes secured to each side thereof which extend laterally of the road finisher. An adjustment beam for carrying a ground support for the finisher includes a rod portion extending into each tube and a respective interior and exterior side wall at the respective ends of the adjustment beam. The rod portions are movable in each tube and they are secured on the portion extending exteriorly of the tube to the exterior side wall. The rods are guided within the tube by guide means which bear between the rod and the tube. In addition, the exterior of the adjustment member is guided by second guide means which support the adjustment beam on the exterior of the tubes. These second guide means include sleeves bearing against the tubes containing the rods and carried by an interior guide wall of the adjustment beam. The rods include pistons at their inner ends and fluid pressure is admitted to respective opposite sides of the pistons in order to extend or retract the adjustment beam in accordance with the road width desired.

6 Claims, 7 Drawing Figures

DEVICE FOR THE ADJUSTMENT OF THE WORKING WIDTH OF ROAD FINISHERS

FIELD AND BACKGROUND OF THE INVENTION

This invention relates in general to the construction of road finishers and, in particular, to a new and useful device for adjusting the working width of the road finishers by shifting the ground contacting portions thereof either inwardly or outwardly.

DESCRIPTION OF THE PRIOR ART

A known device for adjusting the working width of a road finisher includes members which are mounted in a cantilevered fashion on the structure and are provided with slide guides in which sliders are guided and which carry two supports having an adjustment beam which may be displaced laterally. Such a device, which is not embodied in practice, has the disadvantage that due to the simple tandem arrangement in the working direction of the conventional main beam and the two conventional structures serving as adjusting beams, there is a relatively large overall structural length of the structure, which is undesirable. With completely or partly extended adjusting beams, a space is formed ahead of these beams resulting from the width of the main beam in the longitudinal or running direction of the road finisher and the lateral extension of the adjusting beams. In this space, a relatively large part of the material to be spread over the road bed accumulates so that the advance of the road finisher is obstructed. In addition, the tampers which are mounted in advance of the adjusting beams become misadjusted in respect to their height position in an undesirable manner. This is because the main beam and the adjusting beams are freely suspended from the road finisher and an equilibrium is established between the mass of the beam and the mass of the material to be distributed at a certain level above the road foundation to be coated. This undesirable misadjustment in height of the adjusting beams results in errors in the level of the material to be spread over the road bed. In addition, because of the prismatic slide guides which are used, the known device is very susceptible to fouling. Also, because of the prismatic guides and the separate drive which requires a separate piston and cylinder unit, the device is expensive to manufacture. In addition, the guidance of the adjusting beams is relatively unstable.

SUMMARY OF THE INVENTION

In accordance with the invention, the device for adjusting the working width of a road finisher includes a construction providing two tubes firmly fixed to each half of a main beam. An adjusting beam includes rod portions guided in the respective tubes and an exterior and interior side wall which extends in the longitudinal or working direction of the road finisher and is approximately the width of the main beam. The supporting rods are supported by first guide means within the respective tubes and the interior wall includes second guide means which bear against the exterior of the tubes. The construction provides a relatively small overall length for the device in respect to the working direction of the road finisher. This is a great advantage, particularly for the spreading of material over the road bed. The guide tubes are constructed as twin tubes which are arranged in side-by-side relationship in respect to the travel direction of the finisher. The tubes provide an exact guidance of the adjusting beam using two separate guide means effective on the interior and the exterior of the guide tubes.

The advantages of the invention are to be seen particularly in that an unusually uniform feed of material to the road bed is possible because of the narrow beams which are employed. Both the main beam and the adjusting beams are made of compact construction and the adjusting beam may be made compactly not only in the exterior zone but also in the zones where the beam overlaps the main beam. Any danger of the beams becoming distorted due to torsion or bending is substantially prevented. Advantageously, the main beam includes a central plate portion and two guide tubes are secured to respective sides of the plate portion. In addition, at least one of the guide tubes on each side of the main beam is designed as a hydraulic cylinder and the supporting rod which is guided in this tube is provided with a piston portion which is moved within the tube in accordance with the flow of the hydraulic fluid on the respective sides of the piston moving within the tube. Thus, one of the guide tubes provides both the guidance and the drive of the adjusting beam. The construction provides both technological and economical advantages since a separate drive for the displacement of the adjusting beams can be omitted. In the preferred arrangement, the hydraulic cylinder and the associated supporting rod and piston constitute a double-acting piston and cylinder system.

The particular effect of the invention with the two juxtaposed guide tubes for each adjusting beam is that the bottom edges of the main and the adjusting beams are in an exact plane-parallel position and can be displaced while remaining in this exact plane-parallel position. The inventive device is particularly resistant to torsion and bending. Even with the adjusting beams moved completely out, which is possible in a continuous manner, any torsion to any side is eliminated. Since the bottom edges of the beams are exactly aligned, a uniform compacting pressure on the spread layer of material on the road surface can be obtained at all points of the beams.

Accordingly, it is an object of the invention to provide a device for adjusting the working width of road finishers, which comprises a main support beam adapted to be carried on the road finisher and having a central plate portion and with a pair of tubes secured to each side of the main support beam and extending laterally of the road finisher, and with an adjustment beam on each side of the central plate portion having a respective interior and exterior side wall at respective ends thereof and a supporting rod which is movable in each tube and which has an outer end portion secured exteriorly of the associated tube to the exterior side wall of the adjusting beam and, wherein, the adjusting beam is guided by first guide means which guide the inner end portion of the supporting rod within the tube and a second guide means which support the adjusting beam exteriorly of the tube, and wherein, one of the tubes is advantageously a fluid pressure cylinder and advantageously, one of the rods includes a piston which is movable in the cylinder under the controlled action of the fluid pressure.

A further object of the invention is to provide a device for adjusting the working width of road finishers which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
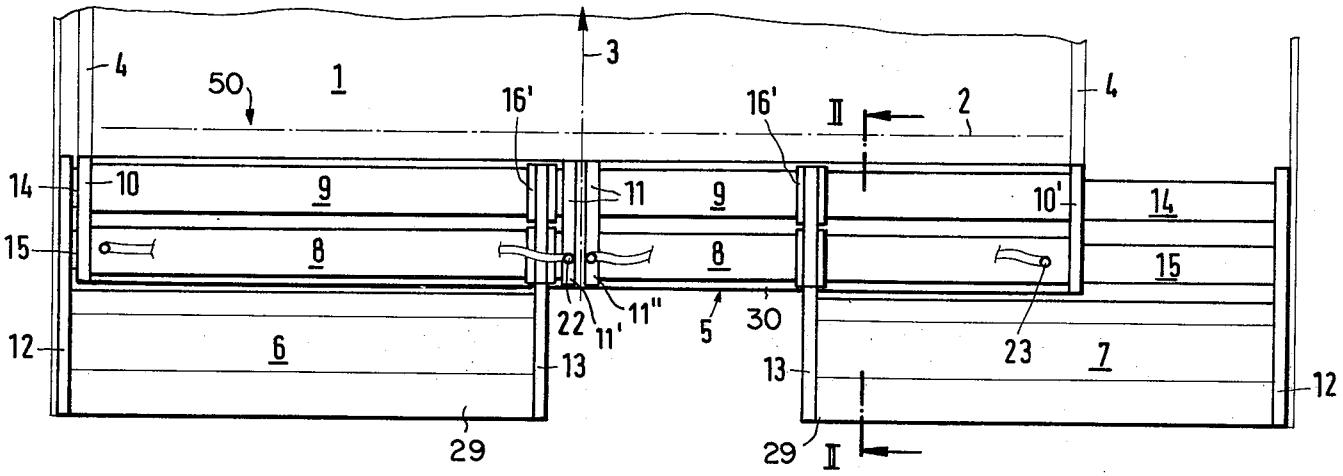
FIG. 1 is a top plan view of a road finisher having an adjusting device thereon constructed in accordance with the invention.
Figure 3:
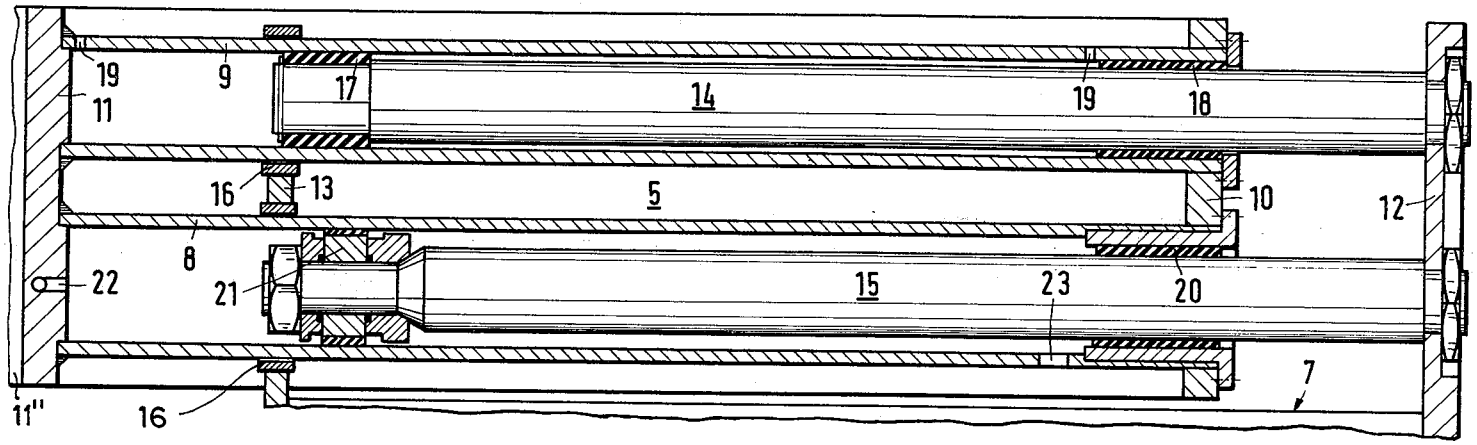
FIG. 3 is a partial sectional view taken along the line III—III of FIG. 2.

Referring to the drawings in particular, the invention embodied therein, comprises a device, generally designated 50, for adjusting the working widths of road finishers, generally designated 1, which is partly shown in the drawings. Road finisher 1 may be of a type, for example, which includes crawler type or track type elements 51 which engage with the ground and move the finisher in a working direction as indicated by the arrow 3. The device 1 comprises a motor vehicle 52 which has a usual control stand 53 (FIG. 4) and is advantageously provided with a trough 54 in the front end (not shown) which is provided for receiving the material to be spread over a road bed over which the device moves in the direction of the arrow 3. The material is supplied across the vehicle and beneath the control stand 53 to a feeding screw which is generally indicated at 2 in the drawings. Feed screw 2 is located ahead of the device for adjusting the widths of the road finisher, designated 50. Advantageously, the adjusting device 50 is supported by support beams 4 for floating.

In accordance with the invention, the adjusting device 50 includes a main beam 5 having a central plate portion 11 and which carries a pair of tubes 8 and 9 which are welded to each side of the central plate portion 11. Tubes 8 and 9 provide guide means and support for two adjusting beams, generally designated 6 and 7, which are arranged on the respective sides of plate portions 11. Central plate portion 11 includes two parts 11' and 11'' which are pivotable about an axis which is parallel to the working direction, as indicated by the arrow 3, in order to be able to adapt the device to a road surface which curves to each side and is of general roof-shape configuration with small angles of inclination to each side of the road. The support tubes 8 and 9 are of thick wall construction and they are welded to central plate portions 11. Main beam 5 also includes exterior side wall portions 10, 10' to which the tubes 8 and 9 are welded.

In accordance with a feature of the invention, tubes 8 and 9 are finished both at their interiors and their exteriors as guide surfaces. Adjusting beams 6 and 7 include exterior side walls 12 and interior side walls 13 which are elongated in the direction of travel 3 and are approximately equal to the width in the longitudinal direction of main beam 5. Each adjusting beam assembly 6 and 7 includes a respective supporting rod 14 and 15 which include inner ends which are guided within the respective guide tubes 8 and 9 and outer ends which are connected to the respective exterior walls 12. The adjusting beams 6 and 7 also include interior walls 13 which carry guide sleeves 16, 16' which engage with the respective inner ends of tubes 8 and 9. The construction ensures against distortion of the parts by torsion and bending by the guidance of the adjusting beam on first guide means in the form of slide rings 17 and 18 around support rods 14 and slide means in the form of a piston 21 and slide ring 20 around the support rod 15 in the guide tube 8 and second guide means which include the guide sleeves 16 and 16' which engage around the exteriors of the respective tubes 8 and 9. Guide tubes 9 are vented at both ends by means of air escape bores 19.

In accordance with another feature of the invention, the support rod 15 carries the piston 21 at their inner ends which are in sliding sealing engagement with the inside surface of guide tubes 8. Inlet ports 22 and 23 are arranged at the respective ends of guide tubes 8 for a fluid supply to respective sides of piston 21 in order to direct it inwardly or outwardly as desired. Guide tubes 8 and the piston 21 constitute double-acting cylinder and piston combinations, so that they provide both a guidance and also a drive for the adjusting beams 6 and 7.

Figure 2:
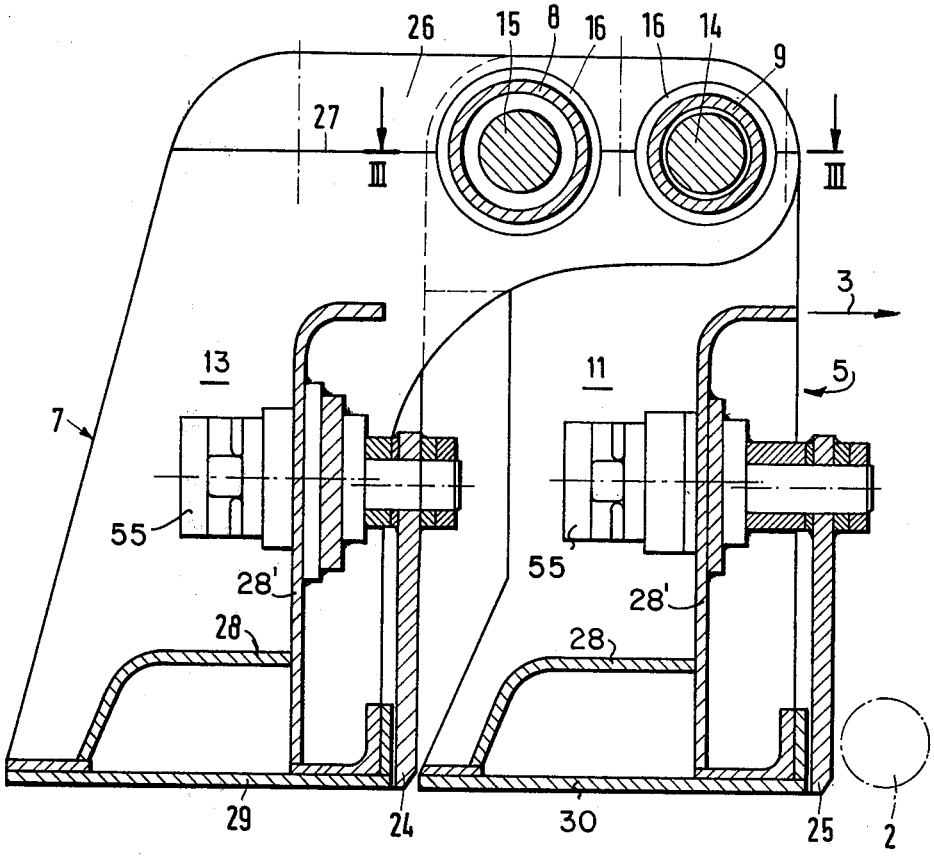
FIG. 2 is a partial sectional view taken along the line II—II of FIG. 1.

As shown particularly in FIG. 2, tampers 24 and 25 are provided to the rear of side walls 13 and 11, respectively. The tampers are movable in a vertical sliding motion by a motor 55. Internal side walls 13 of the adjusting beams 6 and 7 are provided with covers 26 which are screwed to the top and clamp guide sleeves 16 in a separating joint 27. The main beam 5 and the adjusting beams 6 and 7 are advantageously welded structures which include vertical sheets 28' and horizontal sheets 28 and a bottom sheet 29 and 30.

Figure 4:
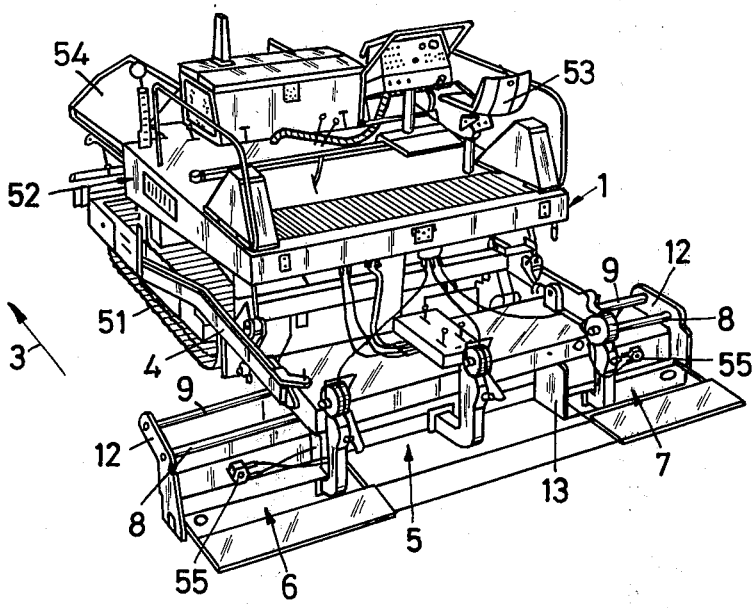
FIG. 4 is a rear and left side perspective view of the road finisher.
Figure 5:
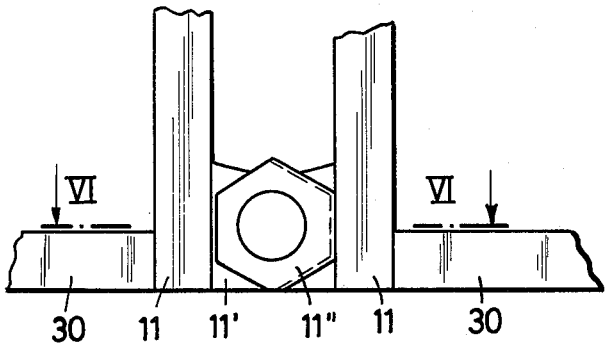
FIG. 5 is a partial side elevational view of the connection 11 shown in FIG. 1.
Figure 6:
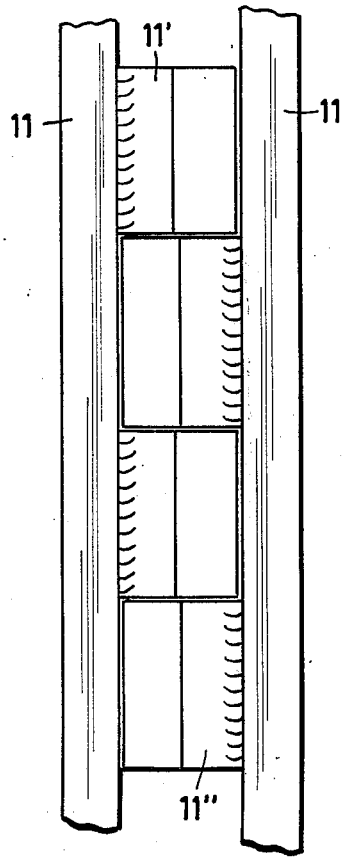
FIGS. 6 and 7 are sectional views taken along the lines VI—VI.
Figure 7:
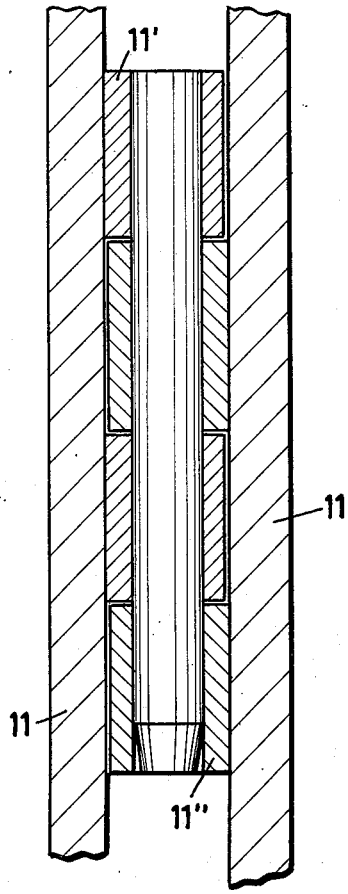

The road finisher 1 travels on its endless tracks 51 in the direction of the arrow 3 as shown in FIG. 4 and is moved by means of the main engine of a motor vehicle 52 which is steered by an operator from a control stand 53. Ahead of the finisher 1 in the travel direction, the material to be spread over the roadbed is dumped from trucks into a trough 54 through which it passes rearwardly to feeding screw 2. Feeding screw 2 distributes the material transversely to the travel direction in front of the beams 5, 6 and 7. The beams 5, 6 and 7 effect the spreading of the material over the bed to be coated and it is compacted by means of tampers 24 and 25 and smoothed by bottom guide sheets 29 and 30.

In order to adapt the working width of finisher 1 to various widths of the roadways to be constructed, adjustment means 6 and 7 are provided which may be laterally extended relative to the fixed main beam 5. The extension and retraction of adjustment beams 6 and 7 is effected by means of double acting cylinder piston units which comprise guide tubes 8. The lateral extension of adjustment beams 6 and 7 is controlled by another operator who performs his work from running boards which are affixed behind the beams 5, 6 and 7.

With the adjustment beams 6 and 7 retracted, the finisher 1 has a width which is adapted for travelling on public roads. At the location of operation, a large working width of the finisher can be obtained in a minimal time by extending adjustment beams 6 and 7 which are extendable independently of each other.

While a specific embodiment of the invention has been shown and described in detail to illustrate the application of the principles of the invention, it will be understood that the invention may be embodied otherwise without departing from such principles.

What is claimed is:

1. A device for adjusting the working width of a road finisher, comprising a main support beam adapted to be carried on the road finisher and having a central plate portion, a pair of tubes secured to each side of said main support beam central plate portion and extending laterally of the road finisher, an adjustment beam on each side of said central plate portion of said main beam having a respective interior and exterior side wall at respective ends thereof, a supporting rod having an inner end portion movable in each tube and an outer end portion secured exteriorly of the associated tube to said exterior side wall of said adjustment beam, first guide means supportably guiding the inner end portion of said supporting rod in a respective one of said tubes, and second guide means supportably guiding said adjustment beam on the exterior of each of said tubes.

2. A device according to claim 1, wherein said main support beam includes a side wall spaced outwardly from said central plate portion and firmly secured around the exterior of each of said tubes.

3. A device according to claim 1, wherein at least one of said tubes comprises a fluid pressure cylinder, said rod in said fluid pressure cylinder having a piston portion which is slidably guided within said tube, said cylinder having means for directing fluid pressure into said cylinder at respective sides of said piston in order to move said piston with the associated adjustment beam inwardly and outwardly of said road finisher.

4. A device according to claim 1, wherein at least one tube on each side of said central plate portion of said main support beam comprises a fluid pressure cylinder, said rod in the associated fluid pressure cylinder having a piston thereon and means for supplying a fluid pressure to respective sides of said piston for shifting said piston in respect to the associated cylinder and for moving said adjustment beam selectively inwardly or outwardly.

5. A device according to claim 4, wherein said first guide means comprises a slide ring around at least one of said supporting rods bearing against the interior of the associated one of said tubes.

6. A device according to claim 5, wherein at least one of said first guide means comprises a piston carried at the inner end of the associated said support rod and being in slidable engagement with the interior wall of said tube.

* * * * *